US011585577B2

(12) United States Patent
Zhang

(10) Patent No.: US 11,585,577 B2
(45) Date of Patent: Feb. 21, 2023

(54) HEAT EXCHANGER

(71) Applicant: CARRIER CORPORATION, Palm Beach Gardens, FL (US)

(72) Inventor: Wei Zhang, Shanghai (CN)

(73) Assignee: CARRIER CORPORATION, Palm Beach Gardens, FL (US)

( * ) Notice: Subject to any disclaimer, the term of this patent is extended or adjusted under 35 U.S.C. 154(b) by 0 days.

(21) Appl. No.: 17/125,111

(22) Filed: Dec. 17, 2020

(65) Prior Publication Data

US 2021/0318039 A1 Oct. 14, 2021

(30) Foreign Application Priority Data

Apr. 9, 2020 (CN) ..... 202010274124.4

(51) Int. Cl.

| | |
|---|---|
| ***F25B 39/02*** | (2006.01) |
| ***F28D 9/00*** | (2006.01) |
| ***F28D 21/00*** | (2006.01) |
| *F28F 9/00* | (2006.01) |

(52) U.S. Cl.

CPC ..... *F25B 39/028* (2013.01); *F28D 9/0043* (2013.01); *F28D 21/0017* (2013.01); *F28D 2021/0071* (2013.01); *F28F 9/005* (2013.01)

(58) Field of Classification Search

CPC .. F25B 39/028; F28D 9/0043; F28D 21/0017; F28D 2021/0071; F28F 9/005

USPC ..... 62/515

See application file for complete search history.

(56) References Cited

U.S. PATENT DOCUMENTS

| | | | | |
|---|---|---|---|---|
| 2,314,598 A * | 3/1943 | Phelan | F25D 31/006 | 366/147 |
| 3,180,408 A * | 4/1965 | Grotz, Jr. | F22B 1/1823 | 165/161 |
| 3,223,746 A * | 12/1965 | Hammond | F28F 27/00 | 585/921 |
| 3,520,354 A * | 7/1970 | Benjamin | F28F 19/008 | 165/97 |
| 3,966,538 A * | 6/1976 | Hagberg | B01D 1/10 | 159/DIG. 10 |
| 5,107,921 A * | 4/1992 | Tsai | F28D 7/1646 | 165/137 |
| 6,910,349 B2 * | 6/2005 | Bodell, II | F25B 41/40 | 62/515 |

(Continued)

FOREIGN PATENT DOCUMENTS

EP 1365199 B1 7/2017

*Primary Examiner* — Tho V Duong
*Assistant Examiner* — Raheena R Malik
(74) *Attorney, Agent, or Firm* — Cantor Colburn LLP

(57) ABSTRACT

The disclosure relates to a heat exchanger. The heat exchanger includes a shell and heat exchange tube bundles located in the shell, the shell has an inlet and an outlet, and a refrigerant flows in through the inlet, exchanges heat with a fluid in the heat exchange tube bundles, and then flows out from the outlet, and the outlet is provided with an extension section that extends into an interior of the shell and has a receiving portion configured to receive at least a part of a liquid in the refrigerant flowing toward the outlet after heat exchange. The disclosure is easy to manufacture, install and maintain, and has a low cost. By optimizing the structure of an outlet pipeline of the heat exchanger, the influence of liquid carryover can be effectively controlled, and the overall performance, safety and reliability of the system can be enhanced.

9 Claims, 6 Drawing Sheets

(56) References Cited

U.S. PATENT DOCUMENTS

| | | | | |
|---|---|---|---|---|
| 7,472,563 | B2 * | 1/2009 | Knoll | F25B 39/022 62/515 |
| 8,944,152 | B2 * | 2/2015 | Kulankara | F28D 7/16 165/113 |
| 9,746,256 | B2 * | 8/2017 | Esformes | F28D 3/04 |
| 2001/0040024 | A1 * | 11/2001 | Blanda, Jr. | C01C 3/022 165/178 |
| 2009/0165497 | A1 * | 7/2009 | Welch | F25B 39/028 165/169 |
| 2010/0242533 | A1 | 9/2010 | De Larminat et al. | |
| 2013/0319039 | A1 * | 12/2013 | Sonninen | F25B 39/022 62/515 |
| 2015/0013951 | A1 | 1/2015 | Numata et al. | |
| 2018/0299172 | A1 | 10/2018 | Hartfield et al. | |

* cited by examiner

HEAT EXCHANGER

CROSS-REFERENCE TO RELATED APPLICATIONS

This application claims the benefit of Chinese Application No. CN202010274124.4 filed Apr. 9, 2020, the disclosure of which is incorporated herein by reference in its entirety.

BACKGROUND

The present disclosure relates to the technical field of heat exchange, and in particular to a heat exchanger.

Various types of heat exchange devices, apparatuses or systems have been provided in the prior art, which have been widely used in many industrial fields, places, etc., and can bring great convenience. However, these existing heat exchange devices, apparatuses or systems still have some drawbacks and shortcomings in aspects such as structural configuration, heat exchange effect, work performance, manufacturing, installation, and maintenance, and can be further improved and optimized.

For example, FIG. 1 shows a side view of the structure of an existing flooded evaporator. Most of shells of such flooded evaporators are cylindrical and have a large space volume. Heat exchange tube bundles are installed at a bottom of the shell. A refrigerant inflows from an inlet A of the shell, and exchanges heat with a fluid in the heat exchange tube bundles before leaving the flooded evaporator from an outlet B of the shell. Due to the limitations such as liquid carryover (LCO), such heat exchangers are usually conservative in design, so as to avoid problems such as expensive improved design and deteriorated system performance caused by the LCO. Therefore, it has been customary for a long time to use baffles in the industry as a solution to mitigate the LCO.

BRIEF DESCRIPTION

In view of the foregoing, the present disclosure provides a heat exchanger, which can solve or at least alleviate one or more of the problems described above as well as problems of other aspects existing in the prior art.

Firstly, according to an aspect of the present disclosure, a heat exchanger is provided, which comprises a shell and heat exchange tube bundles located in the shell, the shell having an inlet and an outlet, and a refrigerant flowing in through the inlet, exchanging heat with a fluid in the heat exchange tube bundles, and then flowing out from the outlet, and the outlet is provided with an extension section extending into an interior of the shell, and the extension section has a receiving portion configured to receive at least a part of a liquid in the refrigerant flowing toward the outlet after heat exchange.

In the heat exchanger according to the present disclosure, optionally, the extension section is provided with one or more valve members configured to be closed when in an initial state or when an internal pressure of the shell reaches a preset value, to prevent the liquid from flowing out of the receiving portion, and to be opened when the liquid received in the receiving portion reaches a preset amount, to allow the received liquid to flow out of the receiving portion and enter the interior of the shell.

In the heat exchanger according to the present disclosure, optionally, the valve member is provided at a bottom of the receiving portion.

In the heat exchanger according to the present disclosure, optionally, an opening is provided at the bottom of the receiving portion, and the valve member is configured into a ⊥-shape, and comprises a first part and a second part located at two ends of the valve member respectively, and a middle part connecting the first part and the second part together, and wherein a cross-sectional area of the first part and a cross-sectional area of the second part are each larger than a cross-sectional area of the opening and a cross-sectional area of the middle part, and the cross-sectional area of the opening is larger than the cross-sectional area of the middle part.

In the heat exchanger according to the present disclosure, optionally, the extension section is provided with one or more through holes opposite to the receiving portion.

In the heat exchanger according to the present disclosure, optionally, the extension section is provided with a liquid block member for blocking the liquid from flowing into the extension section.

In the heat exchanger according to the present disclosure, optionally, the liquid block member is configured as a wire mesh having a structure of at least two layers.

In the heat exchanger according to the present disclosure, optionally, an included angle between a tangential direction of an end surface of a free end of the extension section and a horizontal direction ranges from 45° to 270°.

In the heat exchanger according to the present disclosure, optionally, the extension section is configured into a J shape, and the heat exchanger is a flooded evaporator.

In the heat exchanger according to the present disclosure, optionally, a protruding portion for receiving the valve member is provided at a bottom of the extension section.

From the following detailed description combined with the accompanying drawings, the principles, features, characteristics and advantages of the technical solutions according to the present disclosure will be clearly understood. For example, the present disclosure is easy to manufacture, install and maintain, and has a low cost. By optimizing the structure of an outlet pipeline of the heat exchanger, the LCO can be effectively controlled, which helps to reduce the header space of the heat exchanger or increase the number of heat exchange tubes, so as to achieve a compact heat exchanger design. By applying the present disclosure, the overall performance, safety and reliability of the system can be enhanced, and adverse effects on other components, devices or apparatuses (such as the compressor) associated with the heat exchanger can be avoided.

BRIEF DESCRIPTION OF THE DRAWINGS

The technical solutions of the present disclosure will be described in further detail below with reference to the accompanying drawings and embodiments. However, it should be understood that these drawings are designed merely for the purpose of explanation and only intended to conceptually illustrate the structural configurations described herein, and are not required to be drawn to scale.

DETAILED DESCRIPTION

Figure 1:
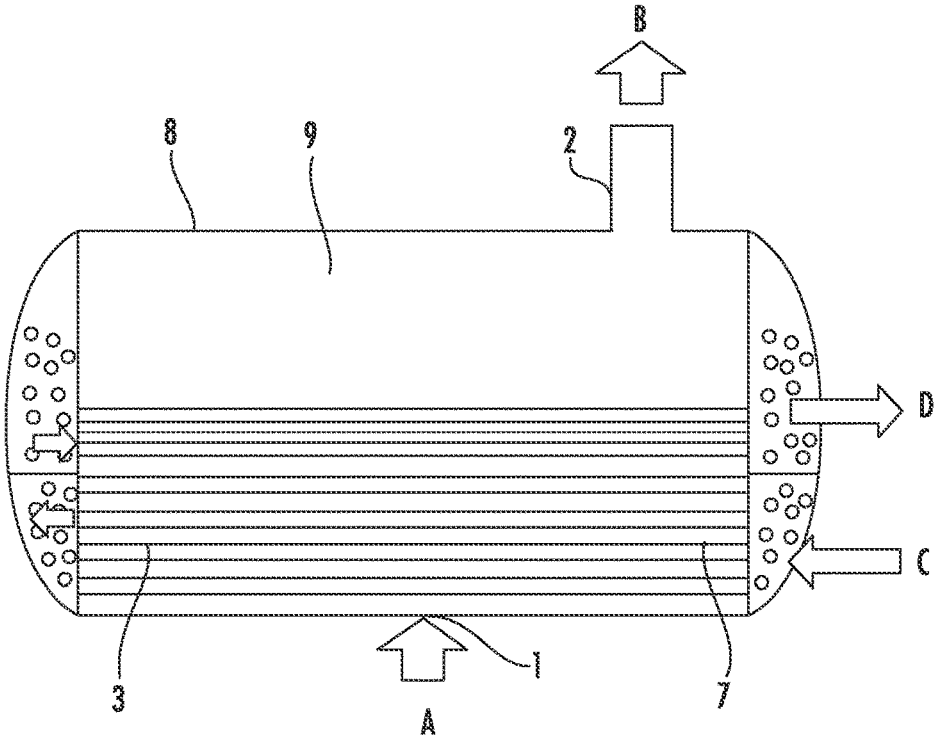
FIG. 1 PRIOR ART
FIG. 1 is a schematic side view showing the structure of a flooded evaporator in the prior art.

Firstly, it is noted that the structural components, characteristics, and advantages of the heat exchanger of the present disclosure will be specifically described below by way of example. However, all the description is only for illustration, and does not limit the present disclosure in any way. Herein, the technical terms "first" and "second" are only used for the purpose of distinguishing the expressions, and are not intended to indicate their order and relative importance. The technical term "substantially" is intended to include non-substantive errors associated with the measurement of a specific amount (for example, it may include a range of ±8%, ±5%, or ±2% of a given value), and the technical terms "upper", "lower", "top", "bottom", "inner", "outer", "left", "right" and derivatives thereof should be related to the orientations in the drawings; unless explicitly indicated otherwise, the present disclosure can take a variety of alternative orientations.

In addition, for any single technical feature described or implied in the embodiments mentioned herein, the present disclosure still allows for any combination or deletion of these technical features (or equivalents thereof) to obtain more other embodiments of the present disclosure that may not be directly mentioned herein. In addition, in order to simplify the drawings, identical or similar parts and features may be marked in only one or more places in the same drawing.

Figure 2:
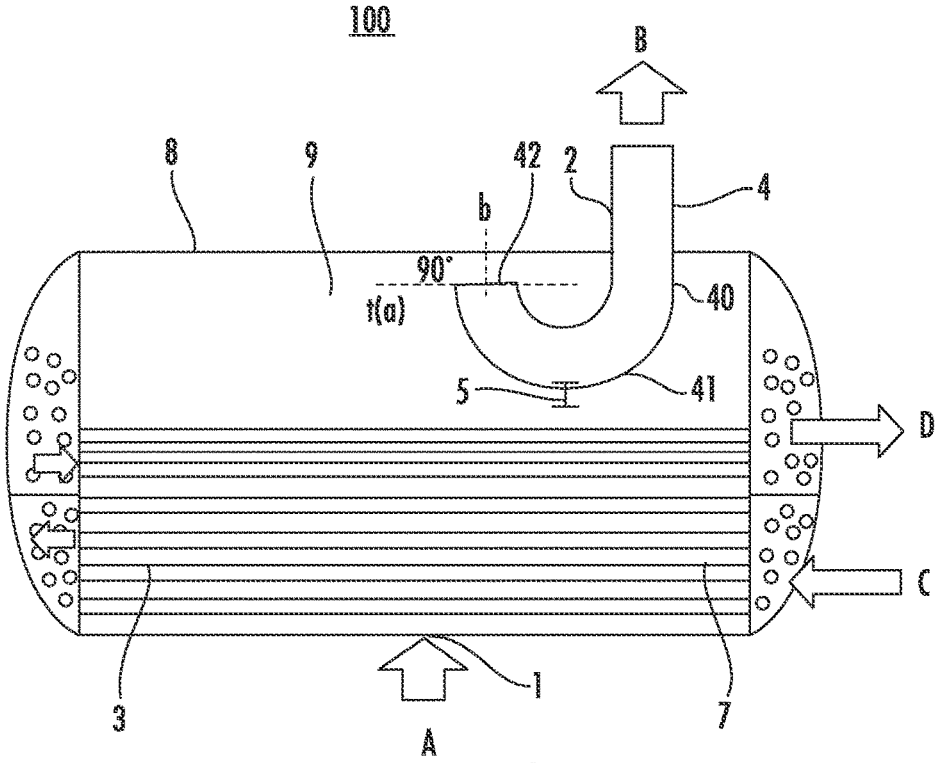
FIG. 2 is a schematic side view showing the structure of a first embodiment of a heat exchanger according to the present disclosure.

FIG. 2 schematically shows the general composition of the first embodiment of the heat exchanger according to the present disclosure. The present disclosure will be first illustrated through this embodiment in the following, so that the obvious advantages of the present disclosure over the existing heat exchangers as shown in FIG. 1 can be clearly understood.

As shown in FIG. 2, the heat exchanger 100 has a shell 8 and heat exchange tube bundles 3 arranged in the shell 8. As for the shell 8, it may be configured into any suitable shape such as a cylinder or a rectangular parallelepiped according to application needs, and forms an inner cavity 9 that can be used to accommodate the heat exchange tube bundles 3. The shell 8 is provided with an inlet 1 and an outlet 2. Any suitable refrigerant 7 such as hydrofluoroolefin (HFO), hydrofluorocarbon (HFC), and R-134a will flow into the shell 8 from the inlet 1 and then from out from the outlet 2. In the above flowing process, the refrigerant 7 will exchange heat with a fluid in the heat exchange tube bundles 3.

Specifically, in FIG. 2, arrows A and B respectively schematically show that the refrigerant 7 enters the inner cavity 9 of the shell 8 from the inlet 1, finally leaves the heat exchanger 100 via the outlet 2, and enters another component, device or apparatus such as a compressor (not shown). Meanwhile, arrow C and arrow D in FIG. 2 also schematically show that another fluid (such as water, ethylene glycol, brine, etc.) will flow through the heat exchange tube bundles 3 arranged in the shell 8. During the flow of the fluid, it will complete heat exchange with the above-mentioned refrigerant 7. Generally, the above-mentioned refrigerant 7 performs boiling heat exchange in the inner cavity 9 of the shell 8, wherein a part of the refrigerant 7 will be evaporated, and then will all flow out from the outlet 2 in a gaseous form or basically in a gaseous form (for example, some gas-liquid mixture may be entrained).

A flow pipe 4 is provided at the outlet 2 of the heat exchanger 100, and the refrigerant 7 after the heat exchange process described above will flow through the flow pipe 4. For example, unlike the existing design shown in FIG. 1, the above-mentioned flow pipe 4 is configured to have an extension section 40; that is, at the outlet 2, there is an extension section 40 that extends into the interior of the shell 8, and the extension section 40 is provided with a receiving portion 41, which can be used to provide a receiving space, so that a part or all of the refrigerant liquid contained in the refrigerant 7 flowing through the receiving portion 41 can be received in the receiving portion 41.

For example, in the embodiment in FIG. 2, the receiving portion 41 is embodied as an arc-shaped portion constituting a part of the extension section 40, so that at least a part of the refrigerant liquid contained in the refrigerant 7 can be retained in such arc-shaped portion. That is to say, this part of the refrigerant liquid can still be trapped inside the shell 8 through the above structure, so it can reduce the refrigerant liquid flowing out from the outlet 2 of the heat exchanger 100 or even prevent the refrigerant liquid from flowing out from the outlet 2 of the heat exchanger 100, which not only can effectively control the LCO and prevent the performances of related components, devices or apparatuses such as the compressor from being easily impaired due to the outflow of the refrigerant liquid, but also can help improve the coefficient of performance (COP) of the system.

In an optional situation, one or more valve members 5 may be provided in the extension section 40; for example, the valve members 5 may be provided at any suitable position on the extension section 40 (such as at the bottom or side of the receiving portion 41). As for the valve member 5, it can be optionally configured to be in a closed state under normal circumstances so that the refrigerant liquid can be received in the receiving portion 41. The valve member 5 can be opened when needed, so as to outwardly release the refrigerant liquid received in the receiving portion 41 so that the refrigerant liquid flows out of the extension section 40. That is, all or part of the refrigerant liquid can be discharged outward into the inner cavity 9 of the shell 8 so that it can continue to participate in the heat exchange with the fluid flowing in the heat exchange tube bundles 3.

According to the teachings of the present disclosure, those skilled in the art can understand that the arrangement positions, number, structures, sizes, materials and other aspects of the valve members 5 may be flexibly designed and adjusted according to specific application needs. For example, they may be set by taking the liquid receiving capacity of the receiving portion 41, control requirements of the LCO and the like into consideration.

Figure 6:
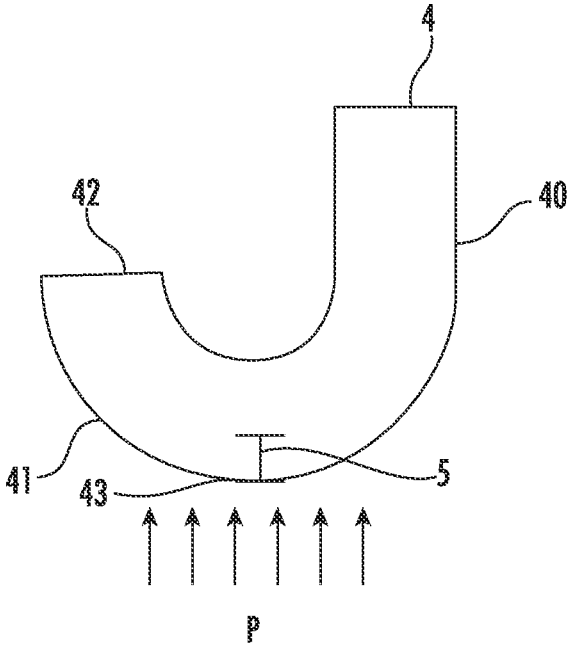
FIG. 6 is a schematic side view showing the structure of the first embodiment of the heat exchanger shown in FIG. 2 when a valve member is closed, in which an extension section is also shown.
Figure 7:
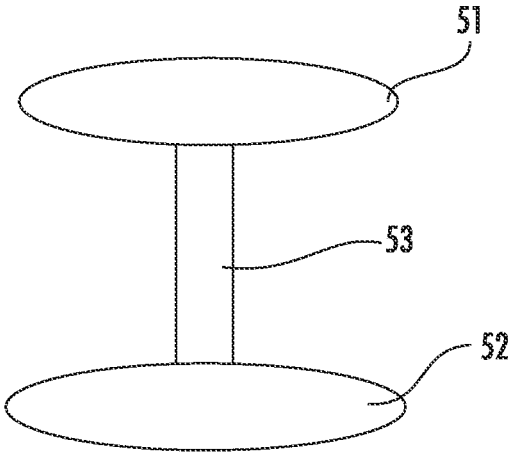
FIG. 7 is a schematic perspective view showing the structure of the valve member in the first embodiment of the heat exchanger shown in FIG. 2.
Figure 8:
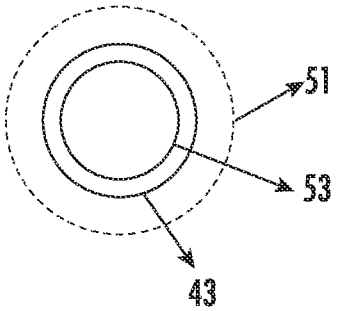
FIG. 8 is a schematic partial top view showing the structure of the first embodiment of the heat exchanger shown in FIG. 2 after the valve member is installed, in which the extension section is also shown.
Figure 9:
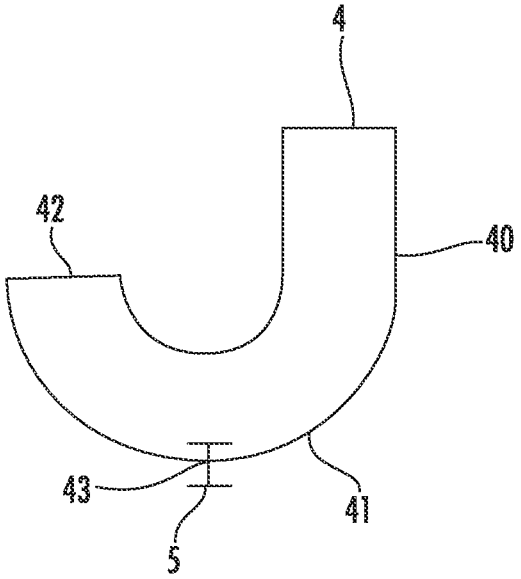
FIG. 9 is a schematic side view showing the structure of the first embodiment of the heat exchanger shown in FIG. 2 when the valve member is opened.
Figures 10A, 10B, 10C, 10D:
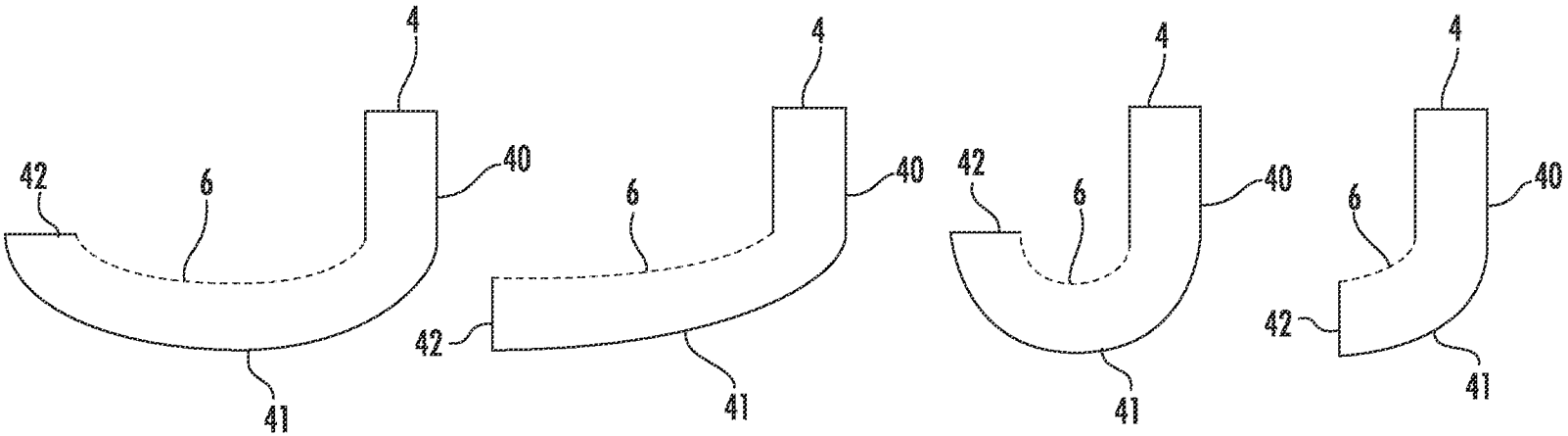
FIGS. 10A-10D are a schematic side views showing the structures of the extension sections in the other four different embodiments of the heat exchanger according to the present disclosure.

As an exemplary illustration, reference is made to FIGS. 6, 7 and 8, which show that the valve member 5 may be optionally configured as a I-shaped structure, and the valve member 5 may be used to cooperate with an opening 43 provided at the bottom of the receiving portion 41.

Specifically, as shown in FIG. 7, the valve member 5 may include a first part 51, a second part 52, and a middle part 53, wherein the first part 51 and the second part 52 are located at both ends of the valve member 5 and connected together by the middle part 53, and these parts may be made of any suitable material such as rubber. In the valve member 5, cross-sectional areas of the first part 51 and the second part 52 may be the same (for example, using a completely symmetrical structure design) or different from each other, but their respective cross-sectional areas are each larger than a cross-sectional area of the opening 43 and a cross-sectional area of the middle part 53, and the cross-sectional area of the opening 43 is larger than the cross-sectional area of the middle part 53.

In this way, in the initial state, the valve member 5 can be in a closed state, that is, the first part 51 blocks the opening 43, and the refrigerant liquid can be received by the receiving portion 41 at this point. In addition, the valve member 5 may be further configured to, under normal circumstances, make the second part 52 abut against and block the opening 43 under the action of a vapor pressure P formed by the evaporated refrigerant 7, when the internal pressure P (the vapor pressure) of the shell 8 reaches a preset value, so that the valve member 5 is closed, and at this point, the refrigerant liquid can be received in the receiving portion 41. When the refrigerant liquid in the receiving portion 41 continuously accumulates to build a gradually increasing liquid pressure, once the refrigerant liquid received in the receiving portion 41 reaches a preset amount and the resulting liquid pressure is greater than the above pressure P, the second part 52 will be pushed away from the opening 43, and the middle part 53 will move downward relative to the opening 43. Since the cross-sectional area of the middle part 53 is smaller than the cross-sectional area of the opening 43, the refrigerant liquid collected in the receiving portion 41 can flow out of the receiving portion 41 through a gap between the opening 43 and the middle part 53; that is, the refrigerant liquid that flows out will be discharged into the inner cavity 9 of the shell 8, and then can continue to participate in the heat exchange process described above.

It should be noted that the above process may be a dynamic balance process. Once the current vapor pressure P is greater than the current pressure of the refrigerant liquid in the receiving portion 41, the valve member 5 will be restored to the original closed state. This process is cycled again and again.

Figure 3:
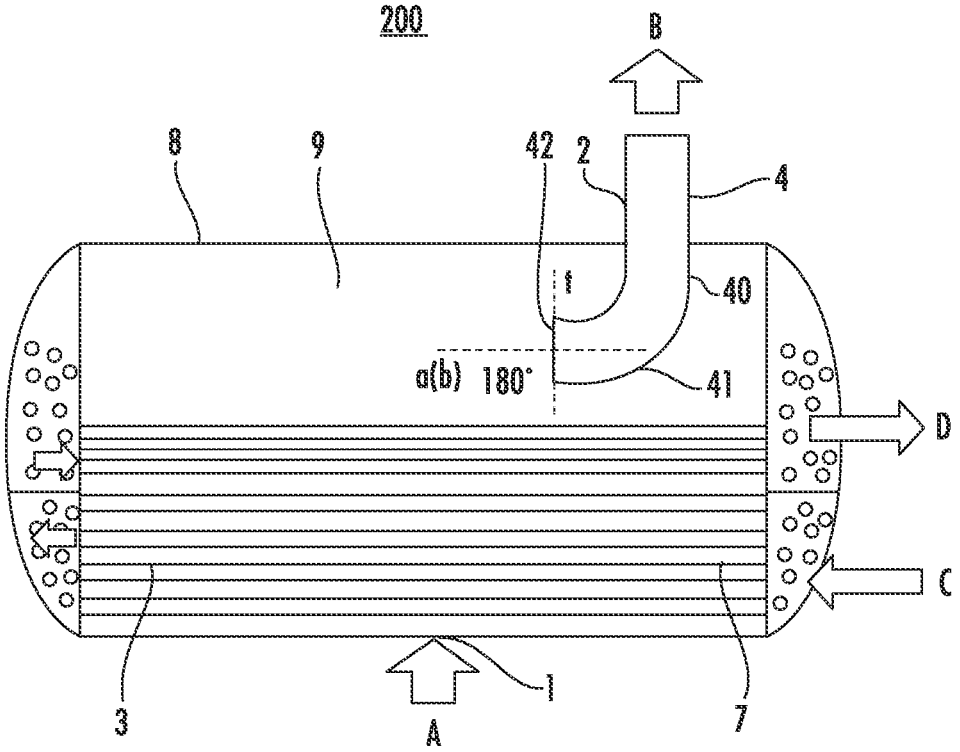
FIG. 3 is a schematic side view showing the structure of a second embodiment of a heat exchanger according to the present disclosure.
Figure 4:
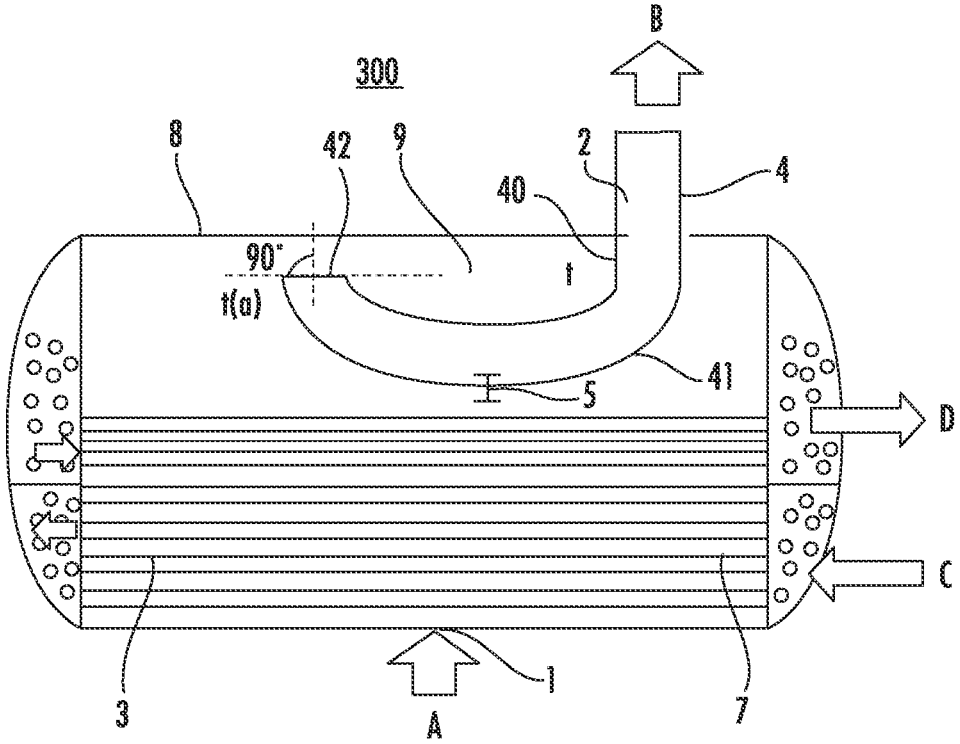
FIG. 4 is a schematic side view showing the structure of a third embodiment of a heat exchanger according to the present disclosure.
Figure 5:
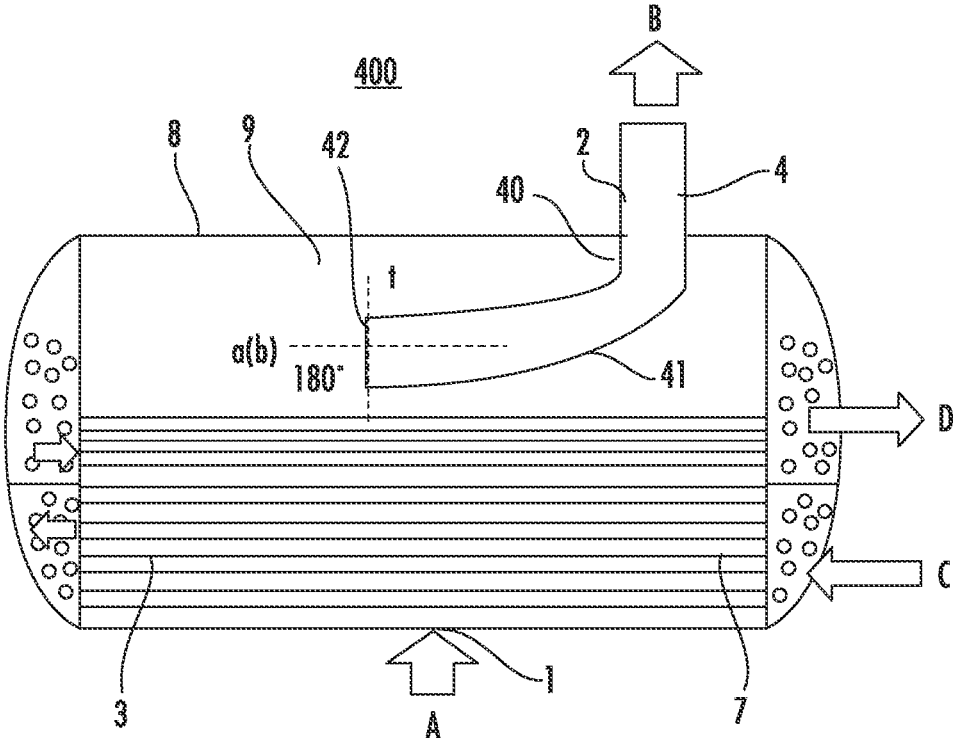
FIG. 5 is a schematic side view showing the structure of a fourth embodiment of a heat exchanger according to the present disclosure.

Next, reference is made to FIGS. 3, 4 and 5, in which structures of the other three heat exchangers 200, 300 and 400 according to the present disclosure are schematically illustrated in side views respectively. In this document, unless specifically stated otherwise, for identical or similar parts of the above three heat exchanger embodiments to those in the embodiment shown in FIG. 2, reference may be directly made to specific description of the corresponding parts in the above since they have already been described previously in great detail, and a repeated description will be omitted.

The heat exchangers 200, 300 and 400 respectively show different configurations that can be used as the receiving portion 41. Specifically, in some applications, the extension section 40 in the flow pipe 4 may be configured in such a way that an included angle formed between a tangential direction t of an end surface of a free end 42 of the extension section 40 and a horizontal direction a, ranges from 45° to 270°.

For example, for the heat exchanger 200 shown in FIG. 3 and the heat exchanger 400 shown in FIG. 5, the included angle formed between the tangential direction t of the end surface of the free end 42 of the extension section 40 of each of them and the horizontal direction a (which coincides with the vertical direction b of the end surface of the free end 42 in this case) is 90°. At this point, the extension section 40 itself has a relatively obvious inclined structure, so it has a relatively small liquid receiving capacity, and when it reaches a certain refrigerant liquid receiving amount, the above structure can be used to facilitate the liquid to flow out from the free end, and the above process can be repeated continuously. Therefore, for situations identical or similar to the above heat exchangers 200 and 400, there may be no need to provide the valve member, or a wire mesh may be inserted at the end of the extension section 40 in this situation to block the entry of liquid droplets.

For another example, for the heat exchanger 300 shown in FIG. 4 and the heat exchanger 100 shown in FIG. 2, the included angle formed between the tangential direction t of the end surface of the free end 42 of the extension section 40 of each of them and the horizontal direction a (which is perpendicular to the vertical direction b of the end surface of the free end 42 in this case) is 180°. At this point, the extension section 40 itself has a relatively obvious arc-shaped downwardly concave structure, so it has a relatively large liquid receiving capacity. Therefore, for situations identical or similar to the above heat exchangers 300 and 100, a valve member may be provided to enhance the handling ability of the receiving portion 41 to receive and discharge the refrigerant liquid, etc.

Next, reference is made to FIGS. 10A-10D, several other optional structural arrangements of the flow pipe 4 applicable to the heat exchanger of the present disclosure are shown schematically. As shown in in FIGS. 10A-10D, one or more through holes 6 may be provided on the extension section 40 of the flow pipe 4. For example, the through holes 6 may be arranged at positions opposite to the receiving portion 41. By arranging the above through holes 6, more refrigerant vapor discharge channels can be provided, which is very advantageous for meeting the control requirements on vapor pressure drop, the LCO and the like in some applications.

In addition, as an optional situation, the present disclosure also allows a liquid block member (not shown) to be provided in the extension section 40 of the flow pipe 4 to block the refrigerant liquid from flowing into the extension section 40. This helps to reduce the outflow amount of the refrigerant liquid from the outlet 2 and effectively prevents it from entering components, devices or apparatuses (such as the compressor) associated with the heat exchanger, which would otherwise cause adverse effects. As an example, the above-mentioned liquid block member can be realized by using a wire mesh having a structure of at least two layers. For example, two or more layers of metal wire meshes are used to form the liquid block member to block the refrigerant liquid. The blocked refrigerant liquid will then drip into the inner cavity 9 of the shell 8 and be heated and evaporated.

Figure 11:
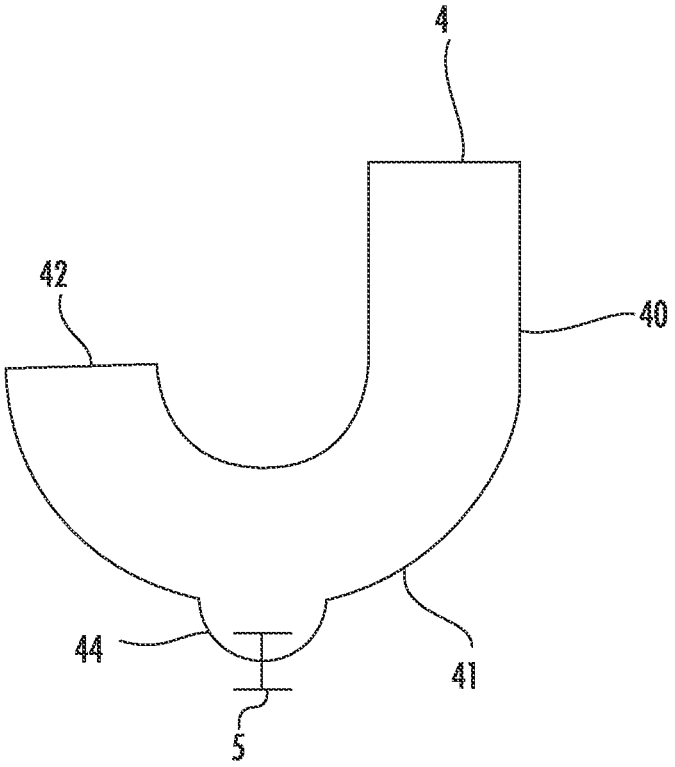
FIG. 11 is a schematic side view showing the structure of the extension section with a valve member in another embodiment of the heat exchanger according to the present disclosure.

The heat exchanger of the present disclosure, especially the flow pipe therein, has been exemplified above in combination with several embodiments. However, it should be understood that the present disclosure allows for changes, replacements, or adjustments to any structural configuration such as the flow pipe and the extension section, the receiving portion and the like therein according to different applications, so as to form more extended designs to fully meet various possible actual needs. For example, although in the previous examples, the flow pipe 4 are configured to be J-shaped as a whole, in some applications, they may be configured to have an irregular shape and have different pipe diameters, etc., and the receiving portion may not be necessarily formed by an arc-shaped portion; instead, the receiving portion may have any feasible structure; for example, it may be implemented through an additional protruding portion 44 schematically shown in FIG. 11 (such as a receiving cavity welded on an outer wall of the flow tube 4) or by using linear straight pipes, etc., as long as the purpose of receiving the refrigerant liquid can be achieved.

According to another technical solution of the present disclosure, a heat exchange system is also provided, which may be provided with the heat exchanger designed and provided by the present disclosure as exemplified above for example; for example, the heat exchanger can be implemented as a heat exchange device such as a flooded evaporator in a heat exchange system, so as to better solve the problems in the prior art for example as mentioned above, and obtain the outstanding technical advantages of the present disclosure over the prior art as discussed above; especially due to the effective control of the LCO, the realization of a heat exchanger more compact in structural arrangement will be promoted, which is very advantageous for reducing the header space of the heat exchanger or increasing the number of heat exchange tubes, and improving the overall performance, safety and reliability of the system. It should be understood that the heat exchange system according to the present disclosure may include, but is not limited to, for example, heating, ventilation and air conditioning (HVAC) systems, transportation refrigeration systems, freezing/refrigeration systems, etc.

The heat exchanger according to the present disclosure has been elaborated above in detail by way of example only. These examples are merely used to illustrate the principles and embodiments of the present disclosure, rather than limiting the present disclosure. Various modifications and improvements can be made by those skilled in the art without departing from the spirit and scope of the present disclosure. Therefore, all equivalent technical solutions should fall within the scope of the present disclosure and be defined by the claims of the present disclosure.

What is claimed is:

1. A heat exchanger, comprising a shell and heat exchange tube bundles located in the shell, the shell having an inlet and an outlet, and a refrigerant flowing in through the inlet, exchanging heat with a fluid in the heat exchange tube bundles, and then flowing out from the outlet, wherein the outlet is provided with an extension section extending into an interior of the shell, and the extension section has a receiving portion configured to receive at least a part of a liquid in the refrigerant flowing toward the outlet after heat exchange;

wherein the extension section is provided with one or more valve members configured to be closed when in an initial state or when an internal pressure of the shell reaches a preset value, to prevent the liquid from flowing out of the receiving portion, and to be opened when the liquid received in the receiving portion reaches a preset amount, to allow the received liquid to flow out of the receiving portion and enter the interior of the shell.

2. The heat exchanger according to claim 1, wherein the valve member is provided at a bottom of the receiving portion.

3. The heat exchanger according to claim 2, wherein an opening is provided at the bottom of the receiving portion, and the valve member is configured into an I-shape, and comprises a first part and a second part located at two ends of the valve member respectively, and a middle part connecting the first part and the second part together, and wherein a cross-sectional area of the first part and a cross-sectional area of the second part are each larger than a cross-sectional area of the opening and a cross-sectional area of the middle part, and the cross-sectional area of the opening is larger than the cross-sectional area of the middle part.

4. The heat exchanger according to claim 1, wherein the extension section is provided with one or more through holes opposite to the receiving portion.

5. The heat exchanger according to claim 1, wherein the extension section is provided with a liquid block member for blocking the liquid from flowing into the extension section.

6. The heat exchanger according to claim 5, wherein the liquid block member is configured as a wire mesh having a structure of at least two layers.

7. The heat exchanger according to claim 1, wherein an included angle between a tangential direction of an end surface of a free end of the extension section and a horizontal direction ranges from 45° to 270°.

8. The heat exchanger according to claim 1, wherein the extension section is configured into a J shape, and the heat exchanger is a flooded evaporator.

9. The heat exchanger according to claim 1, wherein a protruding portion for receiving the valve member is provided at a bottom of the extension section.

* * * * *